US008018708B1

(12) United States Patent
Day

(10) Patent No.: US 8,018,708 B1
(45) Date of Patent: Sep. 13, 2011

(54) MAGNETIC FIELD COMPENSATION FOR VESSELS

(75) Inventor: Dana L. Day, Turnersville, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 182 days.

(21) Appl. No.: 12/557,876

(22) Filed: Sep. 11, 2009

(51) Int. Cl.
*H01H 7/00* (2006.01)

(52) U.S. Cl. ..... 361/139; 361/143

(58) Field of Classification Search ..... 361/139–144
See application file for complete search history.

(56) References Cited

U.S. PATENT DOCUMENTS 2,519,395 A 8/1950 Perlow et al.
2,718,205 A 9/1955 Gebs et al.
4,945,446 A 7/1990 Kuroda et al.
5,483,410 A 1/1996 Holmes et al.
6,911,754 B2 * 6/2005 Johnson ..... 310/90.5
7,113,384 B2 * 9/2006 Swinbanks et al. ..... 361/143

FOREIGN PATENT DOCUMENTS

WO 8702324 A1 4/1987

* cited by examiner

*Primary Examiner* — Danny Nguyen
(74) *Attorney, Agent, or Firm* — Howard IP Law Group, PC

(57) ABSTRACT

A method for magnetically compensating the magnetic field distortion occasioned by a ferromagnetic portion of the hull of a vessel includes providing a plurality of electromagnets at predetermined locations throughout the vessel replacing the conventional ship-sized air coils and controlling the amount of energizing current provided to each of the plurality of electromagnets, appropriate magnetic field is generated for compensating the magnetic field distortion using a fraction of energizing DC current.

7 Claims, 6 Drawing Sheets

MAGNETIC FIELD COMPENSATION FOR VESSELS

This invention was made with Government support under contract no. N00024-03-C-5115 awarded by the Department of Navy. The Government has certain rights in this invention.

CROSS-REFERENCE TO RELATED APPLICATION

None

FIELD OF THE INVENTION

This disclosure generally relates to a method of protecting a maneuverable mobile platform such as an ocean-going vessel by compensating the distortion in the earth's magnetic field caused by the vessel.

BACKGROUND

A vessel made of ferromagnetic material distorts the earth's magnetic field and makes it susceptible to magnetic influence mines. In many military vessels, large vessel sized electric air coils have been employed to attempt to compensate for the vessel's distortion of the earth's magnetic field. But these efforts have been inefficient because the large vessel sized air coils create large magnetic fields inside the vessel that attenuate as they pass through the hull. The large magnetic fields created inside the vessel have also disrupted cathode ray monitors, which in turn needed to be shielded. Therefore, there is a need for an improved means of compensating magnetic fields for vessels.

SUMMARY

Instead of attenuating in the vessel's hull, this invention takes advantage of the vessel's structure by replacing the vessel sized air coils with a system of small ferromagnetic core coils (i.e. electromagnets) placed near the vessel's outer hull. The small electromagnets can be placed in slots cut into the ferromagnetic structural beams next to the outer hull and in the bulkheads within the vessel. Compared to the conventional large vessel sized air coils, the use of a plurality of small electromagnets having a ferromagnetic core allows generation of magnetic fields having same or higher strengths using significantly reduced amount of Direct Current (DC). The arrangement of one set of the electromagnets is locally approximately orthogonal in three dimensions to the vessel's outer hull.

By incorporating the plurality of electromagnets into the vessel's ferromagnetic structures the magnetic fields are channeled through the vessel's ferromagnetic structures as in a transformer magnetic circuit and the magnetic fields inside and outside the vessel similar to the earth's magnetic field strength of 0.5 gauss can be more efficiently and readily obtained.

According to an embodiment of the present disclosure, a method for magnetically compensating the magnetic field distortion occasioned by a ferromagnetic portion of the hull of a vessel includes at least the steps of: providing a plurality of electromagnets at a plurality of predetermined locations throughout the vessel, when energized, producing a directional magnetic field for compensating the magnetic field distortion; storing in a first memory unit, earth's magnetic field map at potential vessel locations; obtaining the vessel's navigation information which includes the location of the vessel, and its heading, pitch and roll information; determining the likely magnetic field distortion outside the vessel using knowledge of the structural geometry of the vessel relative to the earth's magnetic field map stored in the first memory; storing in a second memory unit, information relating to the location of the electromagnets within the vessel, the potential field intensity and the field direction of each of the electromagnets in response to the magnetic field distortion outside the vessel; determining, from the magnetic field distortion outside the vessel and the information stored in the second memory unit, a desired amount of direct current to be applied to each of the electromagnets for generating compensating magnetic fields having direction and magnitudes for canceling the magnetic field distortion outside the vessel; and applying to each of the electromagnets the desired amount of direct current to thereby create a net magnetic field vector substantially equal and oppositely poled to the magnetic field distortion.

BRIEF DESCRIPTION OF THE DRAWINGS

These and other features and advantages of the present disclosure will be more fully disclosed in the following detailed description of a preferred embodiment of the invention, which is to be considered together with the accompanying drawings.

Figure 1A:
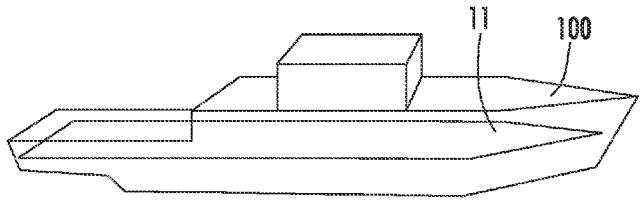
FIG. 1A (PRIOR ART)
FIG. 1A is a diagram of the conventional vessel sized primary horizontal air coil in the hull of a vessel.
Figure 1B:
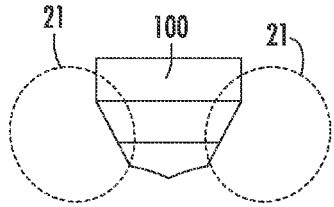
FIG. 1B (PRIOR ART)
FIG. 1B is a diagram of the vessel of FIG. 1A viewed from the bow of the vessel showing the magnetic fields generated by the conventional vessel sized primary horizontal air coil.

All drawings are schematic and are not intended to show any dimensions to scale.

DETAILED DESCRIPTION

This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation.

Existing technology to compensate for the distortion in the earth's magnetic field caused by a ferromagnetic vessel utilizes large air coils similar to those shown in FIGS. 1A-4B. FIG. 1A shows a diagram of a conventional vessel sized primary horizontal air coil 11 provided in the hull of a vessel 100 (e.g. a vessel) for neutralizing vertical magnetization of the vessel 100. The primary horizontal air coil 11 generally encircles the vessel at deck level, or slightly above the water line, and may be placed outside the hull or just within the hull as desired. FIG. 1B graphically illustrates the resulting compensating magnetic fields 21 generated by the vessel sized primary horizontal air coil 11 viewed from the bow of the vessel 100.

Figure 2A:
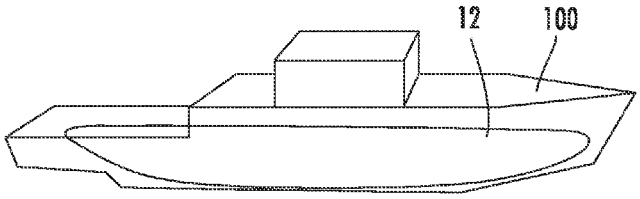
FIG. 2A (PRIOR ART)
FIG. 2A is a diagram of the conventional vessel sized primary longitudinal vertical air coil in the hull of a vessel.
Figure 2B:
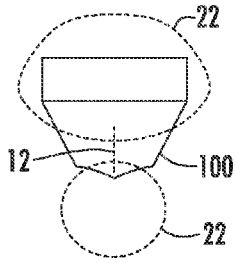
FIG. 2B (PRIOR ART)
FIG. 2B is a diagram of the vessel of FIG. 2A viewed from the bow of the vessel showing the magnetic fields generated by the conventional vessel sized primary longitudinal vertical air coil.

FIG. 2A shows a diagram of a conventional vessel sized primary longitudinal vertical air coil 12 (disposed through the longitudinal vertical plane through the keel of the vessel) provided in the hull of the vessel 100 for neutralizing transverse magnetization of the vessel 100. FIG. 2B graphically illustrates the resulting magnetic fields 22 generated by the conventional vessel sized primary longitudinal vertical air coil 12 viewed from the bow of the vessel 100.

Figure 3A:
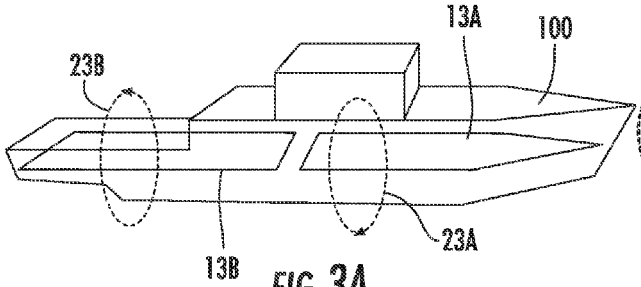
FIG. 3A (PRIOR ART)
FIG. 3A is a diagram of the conventional secondary horizontal air coils in the hull of a vessel.
Figure 3B:
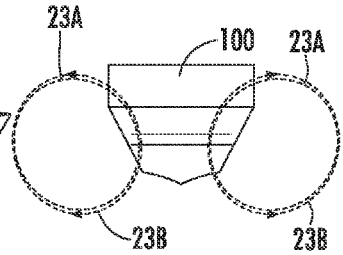
FIG. 3B (PRIOR ART)
FIG. 3B is a diagram of the vessel of FIG. 3A viewed from the bow of the vessel showing the magnetic fields generated by the conventional secondary horizontal air coils.

FIG. 3A shows a diagram of conventional secondary horizontal air coils 13A, 13B in the hull of the vessel 100. These horizontal air coils 13A, 13B are used for neutralizing the vertical component of the field resulting from the longitudinal magnetization of the vessel. FIG. 3B graphically illustrates the corresponding resulting magnetic fields 23A, 23B (which can have opposite polarity as depicted) generated by the conventional secondary horizontal air coils 13A, 13B viewed from the bow of the vessel 100.

Figure 4A:
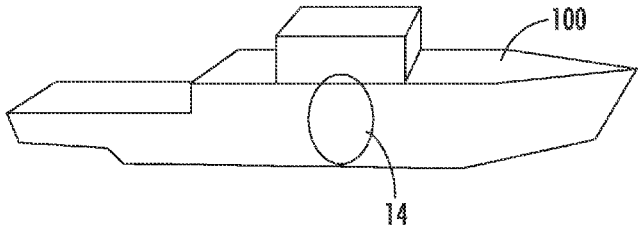
FIG. 4A (PRIOR ART)
FIG. 4A is a diagram of the conventional transverse vertical air coil in the hull of a vessel.
Figure 4B:
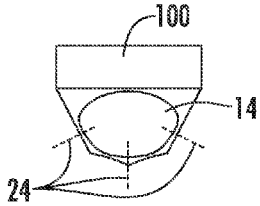
FIG. 4B (PRIOR ART)
FIG. 4B is a diagram of the vessel of FIG. 4A viewed from the bow of the vessel showing the magnetic fields generated by the conventional transverse vertical air coil.

FIG. 4A shows a diagram of a conventional transverse vertical air coil 14 (disposed through a plane transverse to the keel of the vessel) in the hull of the vessel 100 for neutralizing the longitudinal magnetization of the vessel 100. FIG. 4B graphically illustrates the resulting magnetic fields 24 generated by the conventional transverse vertical air coil 14 viewed from the bow of the vessel 100.

FIGS. 1A-4A are showing some of the commonly implemented conventional air coil configurations. A variety of other air coils may be employed depending upon the particular type or classes of vessels.

One of the drawbacks of this conventional system is that many Amperes of DC current is required to generate the magnetic fields large enough to attenuate to the levels outside the vessel 100 that would compensate for the magnetic distortion in the earth's magnetic field caused by the vessel 100.

The magnetic field distortion compensation system of the present disclosure provides an improved means to provide compensation outside the vessel starting at the positions where the conventional air coils' magnetic field attenuated while traversing through the vessel's ferromagnetic structures such as the outer hull and internal structural beams. The magnetic field compensation system of the present disclosure utilizes a plurality of small electromagnets which substantially reduce the DC current required to achieve the same or better result from many Amperes to milli-Amperes and keep the compensating magnetic field strength within and outside the vessel's structure at or below the nominal magnetic field strength of about 0.5 gauss. For example, to generate a field of 0.5 gauss, a 1 cm iron core with 5 loops will require 0.749 milli-Amperes, whereas an open air coil of 15 m diameter with 200 loops will require 6.92 Amperes. The actual diameter of the iron core for the plurality of small electromagnets will depend on the thickness of the ferromagnetic beam structures of the ship.

According to a preferred embodiment, the plurality of small electromagnets are grouped in sets of three and positioned at various locations throughout the vessel's ferromagnetic structures. In each set of three electromagnets, the electromagnets are in mutually substantially orthogonal arrangement to generate horizontal, vertical and normal magnetic fields. The orientations "perpendicular-horizontal," "perpendicular-vertical," and "parallel-vertical" describe the orientation of the electromagnets with respect to the vessel's hull. Such set of three small electromagnets will be referred to as "triplet electromagnets" hereinafter for simplicity.

Figure 5A:
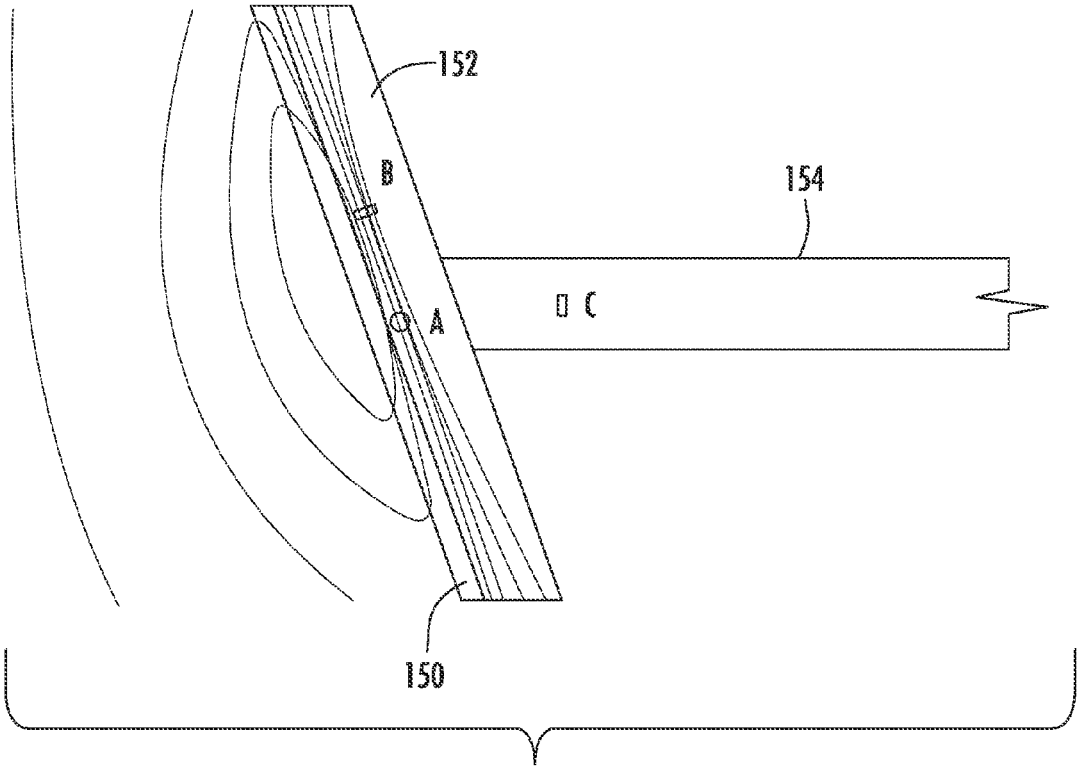
FIG. 5A is a diagram showing a set of three small electromagnets inserted into slots cut into the ferromagnetic structures of the vessel in mutually semi-orthogonal arrangement (to create horizontal, vertical and normal magnetic fields) at a location near the outer hull of a vessel according to an embodiment of the present disclosure where the electromagnets are viewed from a side and the magnetic fields generated from a horizontal electromagnet B are depicted.

FIG. 5A shows an example of such triplet electromagnets A, B and C at a location near the outer hull 150 of the vessel 100. Preferably, slots can be formed in the ferromagnetic structural beams 152, 154 supporting the hull plate 150 to position a set of three small electromagnets A, B, and C at any given location. In the example shown in FIG. 5A, the electromagnet B is positioned in perpendicular-horizontal orientation with respect to the hull plate 150 in the ferromagnetic structural beam 152; the electromagnet A is positioned in parallel-vertical orientation to the hull plate 150 in the ferromagnetic structural beam 152; and the third electromagnet C is positioned in perpendicular-vertical orientation to the hull plate 150 in the ferromagnetic structural beam 154.

In FIG. 5A, the vertical magnetic field generated by the perpendicular-horizontally oriented electromagnet B (a field parallel to the hull plate 150 that is mostly captured within the vessel's structure which spreads throughout the vessel's structure but also leaks outside that structure) is depicted.

Figure 5B:
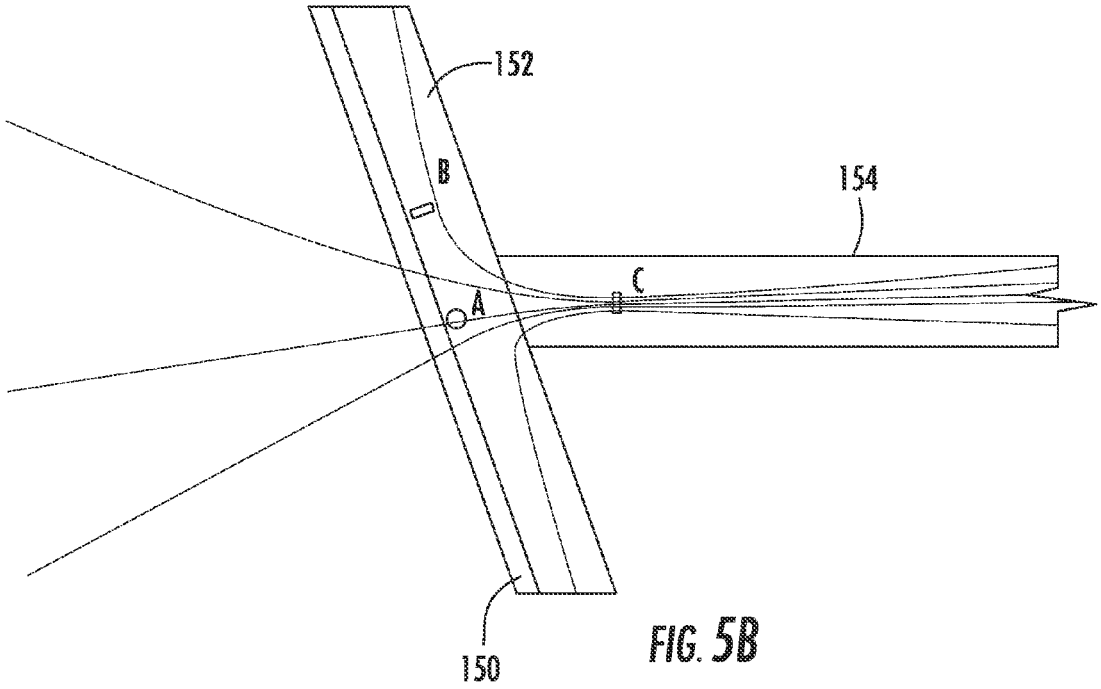
FIG. 5B is a diagram of the same set of three small ferromagnetic core electromagnets as in FIG. 5A where the magnetic fields generated from a vertical electromagnet C on a horizontal beam 154 are depicted.

In FIG. 5B, the normal magnetic field generated by the parallel-vertically oriented electromagnet C (producing a field initially perpendicular to the hull plate 150 that is mostly captured within the vessel's structure which spreads throughout that structure but also leaks outside that structure) is depicted.

Figure 5C:
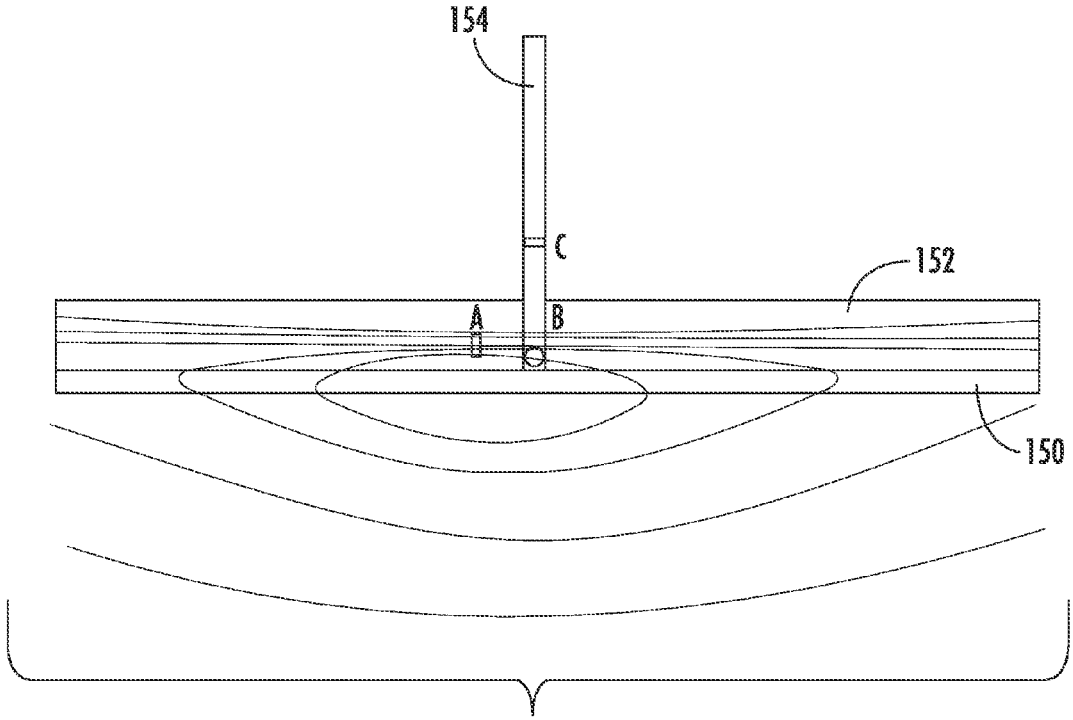
FIG. 5C is the same view as FIG. 5A at a location near the outer hull of the vessel viewed from above but in this diagram, the magnetic fields generated from a vertical electromagnet A on a hull rib 152 are depicted.

In FIG. 5C, the horizontal magnetic field generated by the perpendicular-vertically oriented electromagnet A (also producing a field parallel to the hull plate 150 that is mostly captured within the vessel's structure which spreads throughout that structure but also leaks outside that structure) is depicted.

The magnetic field compensation system of the present disclosure utilizes a plurality of the triplet electromagnets A, B, C positioned at multiple locations throughout the vessel 100. According to an embodiment, a plurality of triplet electromagnets A, B, C are positioned so that at a minimum all or some of the coils in the plurality of triplet electromagnets can be energized or activated to generate compensating magnetic fields that are at least equivalent to the compensating magnetic fields generated by the conventional large air coils shown in FIGS. 1, 2, 3 and 4.

The triplet electromagnets A, B, C can be used to replace the conventional air coils 11, 12, 13A, 13B and 14 discussed above. This is achieved by placing a plurality of the triplet electromagnets A, B, C spaced apart at locations outlining where the conventional air coils would have been.

Figure 6A:
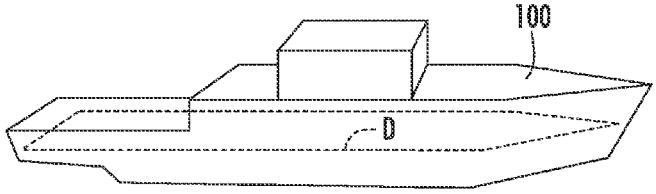
FIG. 6A is a diagram of some of the locations for the small electromagnets to be placed in lieu of the vessel sized primary horizontal air coil in the hull of a vessel.
Figure 7A:
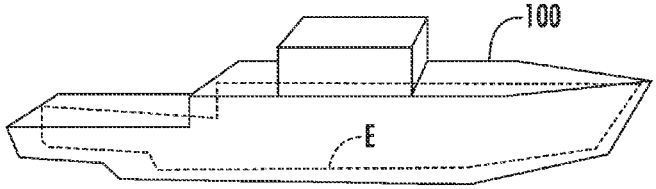
FIG. 7A is a diagram of the locations of the small ferromagnetic core coils for replacing the conventional vessel sized main longitudinal vertical air coil in the hull of a vessel.

For example, the dashed line D in FIG. 6A illustrates a plurality of triplet electromagnets A, B, C placed spaced apart along an outline mimicking where the conventional horizontal primary air coil 11 would have been located in the vessel 100 shown in FIG. 1A. The dashed line E in FIG. 7A illustrates a plurality of triplet electromagnets, A, B, C placed spaced apart along an outline mimicking where the conventional vertical primary air coils 12 would have been located in the vessel 100 shown in FIG. 2A. The conventional air coils 13A, 13B and 14 can be similarly replaced by a plurality of triplet electromagnets A, B, C. The actual locations of each of the triplet coils will depend upon the locations and spacing of the ferromagnetic structural beams in the particular vessel 100.

Once the plurality of triplet electromagnets A, B, C are deployed throughout the vessel 100 in the manner just described, the magnetic field compensation system of the present disclosure can selectively energize particular coils in the triplet electromagnets A, B, C to generate desired compensating magnetic fields. For example, depending upon the vessel's ferromagnetic geometry, all or some of the electromagnets A, B, or C in the triplet coils can be energized. The strength of the compensating magnetic field is controlled by controlling the amount of the DC current energizing the ferromagnetic core coils.

Figure 6B:
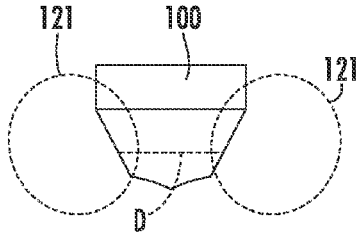
FIG. 6B is a diagram of the vessel of FIG. 6A viewed from the bow of the vessel showing the magnetic fields generated by the small electromagnets.

In one embodiment, the compensating magnetic fields 21 (see FIG. 1B) generated by the conventional primary horizontal air coil 11 of FIG. 1A are generated by energizing only the normally oriented electromagnets B of the plurality of triplet electromagnets A, B, C placed along the dashed line D in FIG. 6A. FIG. 6B shows the resulting compensating magnetic fields 121 generated by the B electromagnets similar to the compensating magnetic fields 21 shown in FIG. 1B.

Figure 7B:
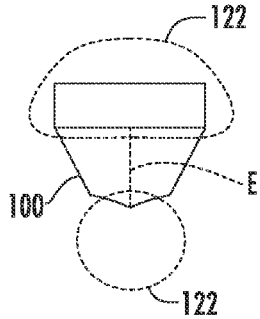
FIG. 7B is a diagram of the vessel of FIG. 7A viewed from the bow of the vessel showing the magnetic fields generated by the small electromagnets.

Similarly, the compensating magnetic fields 22 (see FIG. 2B) generated by the conventional primary vertical air coil 12 of FIG. 2A are generated by energizing only the vertical A electromagnets of the plurality of triplet electromagnets A, B, C placed along the dashed line E in FIG. 7A. FIG. 7B shows the resulting compensating magnetic fields 122 generated by the A electromagnets similar to the compensating magnetic fields 22 shown in FIG. 2B.

Similar arrangements can be made to generate the compensating magnetic fields 23A, 23B and 24 generated by the conventional air coils 13A, 13B and 14 with a plurality of triplet electromagnets A, B, C placed at locations near where the conventional air coils 13A, 13B and 14 would have been.

Therefore, based on the discussion above, the system for magnetically compensating the magnetic distortion occasioned by a ferromagnetic portion of the hull of a vessel according to an embodiment of the present disclosure is comprised of at least one set of a plurality of small electromagnets that are positioned around the vessel in the vessel's ferromagnetic structures. The plurality of small electromagnets are positioned around the vessel whereby when the electromagnets are energized with a proper level of DC current, the electromagnets generate a desired compensating magnetic field similar to the compensating magnetic field generated by the conventional vessel sized air coil systems. The benefit of the present system is that because small electromagnets are utilized, a much smaller amount of DC current can be used to achieve the same or better performance results.

According to other embodiments of the present disclosure, additional triplet electromagnets A, B, C can be deployed at more positions, in addition to those mimicking the placements of the conventional air coils, throughout the vessel 100 to improve magnetic field compensation performance.

Figure 8:
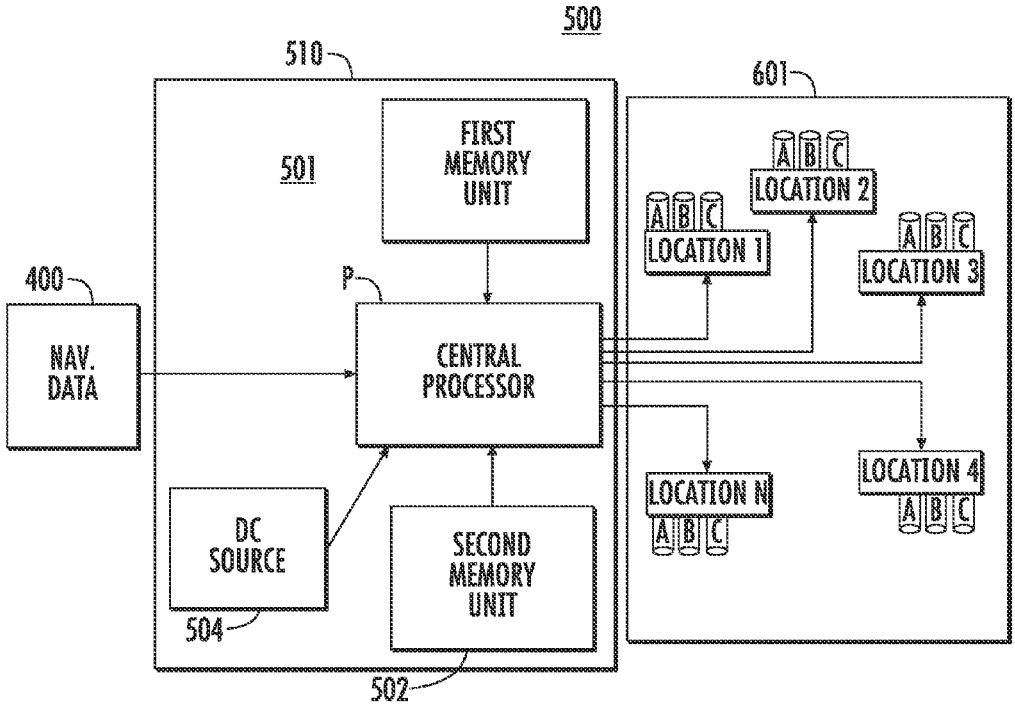
FIG. 8 is a diagram of a system for compensating for the magnetic distortion caused by the vessel.

FIG. 8 shows a magnetic distortion compensation system 500 for improved magnetic field compensation performance that can provide computer control of the at least one set of a plurality of electromagnets described above. The magnetic distortion compensation system 500 includes a control unit 510. The control unit 510 is comprised of a first memory unit 501 stored in which is the earth's magnetic field map. The earth's magnetic field map is a database containing information on the changing magnetic field as a function of geographic location and time.

The control unit 510 is connected to the vessel's navigation system and is configured to receive the vessel's navigation data 400 and made available to the central processor P of the control unit 510 as necessary. The navigation data 400 includes such parameters as the vessel's latitude, longitude, roll, pitch and yaw along with a time stamp providing the vessel's navigation information at any given time. The central processor P uses the navigation data 400 in combination with the earth's magnetic field map from the first memory unit 501 and determines the likely magnetic field distortion outside the vessel.

The control unit 510 also includes a second memory unit 502 in which the central processor P stores a database of the information on the distortion in the earth's magnetic field caused by the vessel's ferromagnetic geometry (i.e. the ferromagnetic structural characteristics of the vessel).

The control unit 510 is operably connected to one or more of the sets 601 of plurality of small electromagnets positioned throughout the ship in a manner that allows the central processor P to send a desired amount of DC current from the DC power source 504 to each of the electromagnets in the set 601 of a plurality of small electromagnets to generate a desired compensating magnetic field. The desired amount of DC current to be applied to each of the plurality of small electromagnets in the set 601 can be determined by a process of calculating superposition of the distorted magnetic field around the ship and the compensating magnetic field to be generated by the plurality of electromagnets. Through a process of addition and subtraction of magnetic field vectors, a compensating magnetic field that will compensate the distortion caused by the ship to produce undisturbed magnetic field around the ship is determined. Once the compensating magnetic field is determined, the desired DC current to be applied to each of the electromagnets necessary to produce the compensating magnetic field is readily calculated.

Figure 9:
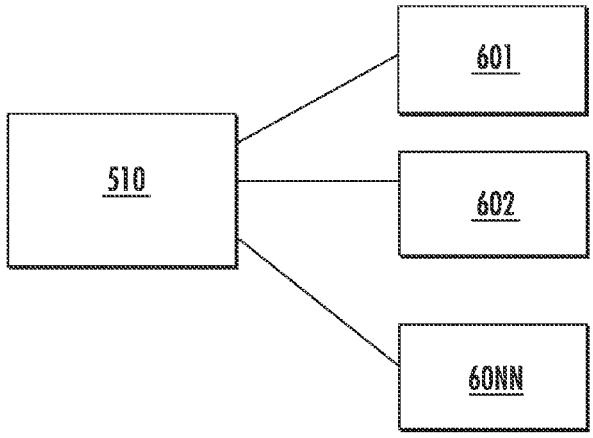
FIG. 9 is a diagram of a system for compensating for the magnetic distortion caused by the vessel according to another embodiment.

In the illustrated example of FIG. 8, only one set 601 of a plurality of small electromagnets is shown to simplify the illustration. However, as discussed above, the present invention encompasses a magnetic distortion compensation system 500 that includes a plurality of sets of small electromagnets. For example, FIG. 9 shows a magnetic distortion compensation system 500 that is operably connected to multiple sets 601, 602 . . . 6NN of a plurality of small electromagnets.

In the illustrated example of FIG. 8, the set 601 of a plurality of small electromagnets is comprised of a plurality of triplet electromagnets (comprising electromagnets A, B and C) at locations 1 through NN. According to other embodiments as discussed above, a set of a plurality of small electromagnets can be comprised of only one type of electromagnets from the triplet. In other words, in a given set of a plurality of small electromagnets, only the electromagnets A, B, or C can be used depending on the orientation of the electromagnets that are desired. The benefit of utilizing the triplet electromagnets is that once such hardware is installed, one has the option of energizing all three types of electromagnets A, B, or C or a subset of them depending on the requirement.

According to an embodiment of the present disclosure, a method for magnetically compensating the magnetic distortion occasioned by a ferromagnetic portion of the hull of a vessel includes at least the steps of providing a plurality of electromagnets (601 . . . 6NN) at a plurality of predetermined locations throughout the vessel, when energized, producing a directional magnetic field for compensating the magnetic distortion; storing in a first memory unit, earth's magnetic field map of earth's magnetic field at potential vessel locations; obtaining the vessel's navigation information which includes the location of the vessel, and its heading, pitch and roll information; determining the likely magnetic field distortion outside the vessel using the earth's magnetic field map stored in the first memory and the vessel's navigation information; storing in a second memory unit, information on the distortion in the earth's magnetic field caused by the vessel's ferromagnetic geometry; determining, from the magnetic field distortion outside the vessel and the information stored in the second memory, a desired amount of direct current to be applied to each of the electromagnets for generating compensating magnetic fields having direction and magnitudes for canceling the magnetic field distortion outside the vessel; and applying to each of the electromagnets the desired amount of direct current to thereby create a net magnetic field vector substantially equal and oppositely poled to the magnetic field distortion.

The likely magnetic field distortion outside the vessel can be calculated by a finite element model and solving for the electro-magnetic equations using an off the shelf program. The finite element model would be verified by actual measurements before being deployed in the magnetic distortion compensation system.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for magnetically compensating the magnetic field distortion occasioned by a ferromagnetic portion of the hull of a vessel:

providing a plurality of electromagnets at a plurality of predetermined locations throughout said vessel, when energized, producing a directional magnetic field for compensating said magnetic field distortion;

storing in a first memory, earth's magnetic field map, which is a database of information on the earth's magnetic field at potential vessel locations;

obtaining the vessel's navigation information which includes the location of said vessel, and its heading, pitch and roll information;

determining the likely magnetic field distortion outside the vessel using the earth's magnetic field map stored in said first memory and the vessel's navigation information;

storing in a second memory, information on the location of said electromagnets within the vessel, the field intensity and the field direction of each of said electromagnets in response to said magnetic field distortion outside the vessel;

determining, from said magnetic field distortion outside the vessel and said information stored in said second memory, a desired amount of direct current to be applied to each of said electromagnets for generating compensating magnetic fields having direction and magnitudes for canceling said magnetic field distortion outside the vessel; and energizing said electromagnets by applying to each of said electromagnets said desired amount of direct current, thereby creating a net magnetic field vector substantially equal and oppositely poled to said magnetic field distortion.

2. The method of claim 1, wherein said plurality of electromagnets are provided in sets of triplet electromagnets provided at each of the plurality of predetermined locations throughout said vessel.

3. The method of claim 2, wherein each electromagnet in each of the triplet of electromagnets are oriented mutually substantially orthogonal to each other.

4. The method of claim 2, wherein energizing said electromagnets comprising providing a desired amount of direct current to at least one electromagnet in each of said sets of triplet electromagnets.

5. A system for magnetically compensating the magnetic field distortion occasioned by a ferromagnetic portion of the hull of a vessel, said system comprising:

one or more sets of a plurality of electromagnets positioned throughout said vessel;

a control unit operably connected to said one or more sets of a plurality of small electromagnets, said control unit comprising:

a first memory unit, stored in which is earth's magnetic field map;

a second memory unit, stored in which is a database of the information on the distortion in the earth's magnetic field caused by the vessel's ferromagnetic geometry; and a power source for providing DC current for energizing said electromagnets;

wherein said control unit energizes said plurality of small electromagnets and generates compensating magnetic field for compensating the magnetic field distortion.

6. The system of claim 5, wherein said one or more sets of a plurality of electromagnets are provided in sets of triplet electromagnets provided at each of the plurality of predetermined locations throughout said vessel.

7. The system of claim 6, wherein each electromagnet in each of the triplet of electromagnets are oriented mutually substantially orthogonal to each other.

* * * * *